US005972147A

United States Patent [19]

Janis

[11] Patent Number: 5,972,147

[45] Date of Patent: Oct. 26, 1999

[54] METHOD OF MAKING FIBROUS, BONDED POLYOLEFIN SHEET

[75] Inventor: Rudolph F. Janis, Richmond, Va.

[73] Assignee: E. I. du Pont de Nemours and Company, Wilmington, Del.

[21] Appl. No.: 09/120,482

[22] Filed: Jul. 22, 1998

Related U.S. Application Data

[63] Continuation-in-part of application No. 08/636,447, Apr. 23, 1996, abandoned.

[51] Int. Cl.[6] ..... B32B 31/00; B29C 55/06

[52] U.S. Cl. ..... 156/181; 156/166; 156/229; 156/296; 156/308.2

[58] Field of Search ..... 156/181, 166, 156/296, 229, 308.2; 264/288.8

[56] References Cited

U.S. PATENT DOCUMENTS

| | | |
|---|---|---|
| 3,081,519 | 3/1963 | Blades et al. . |
| 3,169,899 | 2/1965 | Steuber . |
| 3,246,365 | 4/1966 | Kloender . |
| 3,442,740 | 5/1969 | David . |
| 3,532,589 | 10/1970 | David . |
| 3,536,552 | 10/1970 | Lee . |
| 4,069,078 | 1/1978 | Marder et al. . |
| 4,091,137 | 5/1978 | Miller . |
| 4,554,207 | 11/1985 | Lee . |
| 4,652,322 | 3/1987 | Lim . |
| 4,999,222 | 3/1991 | Jones et al. . |
| 5,057,351 | 10/1991 | Jones et al. . |
| 5,085,817 | 2/1992 | Jones et al. . |
| 5,122,412 | 6/1992 | Jones et al. . |
| 5,308,691 | 5/1994 | Lim et al. . |
| 5,607,636 | 3/1997 | Ito et al. . |

FOREIGN PATENT DOCUMENTS

| | | |
|---|---|---|
| 1280061 | 11/1989 | Japan . |
| 6 712 632 | 11/1967 | Netherlands . |
| WO 88/02795 | 4/1988 | WIPO . |
| WO 97/12086 | 4/1997 | WIPO . |

*Primary Examiner*—Jeff H. Aftergut

[57] ABSTRACT

A process is provided for producing a bonded nonwoven sheet from a lightly consolidated fibrous polyolefin sheet wherein the sheet is preheated on one or more preheating rolls, is bonded in one or more calendering nips, and is cooled on one or more cooling rolls. The process is used to make bonded polyolefin fibrous sheets that are smooth, are substantially impermeable to air and water, and are moisture vapor permeable.

11 Claims, 1 Drawing Sheet

METHOD OF MAKING FIBROUS, BONDED POLYOLEFIN SHEET

This application is a continuation-in-part of U.S. patent application Ser. No. 08/636,447, filed on Apr. 23, 1996, now abandoned.

FIELD OF THE INVENTION

This invention relates to a bonded nonwoven sheet made from a fibrous polyolefin material. More particularly, the invention relates to a bonded nonwoven sheet that is smooth, permeable to moisture vapor, and substantially impermeable to air and water. The invention also relates to a bonding process for producing such a sheet.

BACKGROUND OF THE INVENTION

Processes for manufacturing fibrous nonwoven sheets from polyolefin polymers are known in the art. Blades et al., U.S. Pat. No. 3,081,519 (assigned to E.I. DuPont de Nemours & Company (hereinafter "DuPont")), discloses flash-spinning of plexifilamentary polyethylene film-fibrils. Steuber, U.S. Pat. No. 3,169,899 (assigned to DuPont), discloses depositing a flash-spun polyethylene plexifilamentary film-fibril web onto a moving belt and compressing the deposited web to form a lightly consolidated nonwoven sheet. The term "plexifilamentary" means a three-dimensional integral network of a multitude of thin, ribbon-like, film-fibril elements of random length and with a mean thickness of less than about 4 microns, and with a median fibril width of less than about 25 microns. In plexifilamentary structures, the film-fibril elements are generally coextensively aligned with the longitudinal axis of the structure and they intermittently unite and separate at irregular intervals in various places throughout the length, width and thickness of the structure to form the three-dimensional network.

In order to produce sheets with the strength and barrier properties required for many applications, such as air infiltration barrier sheet material used in home construction (housewrap), the film-fibrils or other fibers of the lightly consolidated sheet material must be bonded together. Lightly consolidated nonwoven sheets made from polyolefin fibers have been bonded by calendering and hot air treatments. However, sheets so bonded have tended to melt, shrink and curl, resulting in sheets with irregular thickness, opacity, strength and permeability properties.

A process for bonding polyolefinic plexifilamentary, film-fibril sheets with properties sufficiently uniform for commercial applications is disclosed in David, U.S. Pat. No. 3,532,589 (assigned to DuPont) and is shown in FIG. 1. The thermal bonding process disclosed in the David patent requires that the unconsolidated film-fibril sheet 5 from supply roll 6 be subjected to light compression during heating in order to prevent shrinkage and curling of the bonding sheet. A flexible belt 2 is used to compress a sheet being bonded against a large heated drum 1 that is made of a heat-conducting material. Tension in the belt is maintained by the rolls 3. The belt is preheated by a heating roll 9 and a heated plate 10. The drum 1 is maintained at a temperature substantially equal to or greater than the upper limit of the melting range of the film-fibril elements of the sheet being bonded. The rotating heated drum 1 is large (about 2 m in diameter) so as to permit the film-fibril sheet to be heated long enough to allow the face of the sheet against the roll to reach a temperature within 7° C. of the upper limit of the melting range of the film-fibril elements, but not substantially above said upper limit, and to allow the second face of the sheet to reach a temperature between 0.8° to 10° C. lower than the temperature of the first face of the sheet. The heated sheet 5 is removed from the heated drum 1 without removing the belt restraint and the sheet is then transferred to a cooling roll 4 where the temperature of the film-fibril sheet throughout its thickness is reduced to a temperature less than that at which the sheet will distort or shrink when unrestrained. Roll 7 removes the bonded sheet from the belt 2 before the sheet is collected on a collection roll 8. The sheet may be run through another thermal bonding device like that shown in FIG. 1 with the second surface facing the heated drum in order to produce a hard bonded surface on the opposite side of the sheet.

For the past twenty-five years, a thermal bonding process similar to that shown in FIG. 1 has been applied to the commercial production of hard-surfaced spunbonded polyolefin sheet material, such as TYVEK® spunbonded polyethylene sheet sold by DuPont. TYVEK® is a registered trademark of DuPont. This experience has demonstrated that the bonding apparatus shown in FIG. 1 is costly to construct, operate and maintain. The large heating drums are expensive to construct, they require large amounts of energy to heat, and their surfaces are difficult to keep clean. The flexible belt 2 used in the prior art process is similarly expensive to heat and maintain. In addition, the bonding process shown in FIG. 1 offers little flexibility for altering the degree of bonding in a sheet product or for producing sheet structures that are extra highly impermeable to air and water, while maintaining good moisture vapor transmissibility. Finally, the bonding process shown in FIG. 1 cannot be used to produce an embossed, point bonded, or otherwise patterned sheet without additional processing steps. Accordingly, there is a need for a lower cost process for bonding plexifilamentary film-fibril sheet material that also offers the flexibility to produce a variety of bonded sheet products including sheet structures that have excellent strength yet are also very smooth and printable, and sheet structures that are highly impermeable to air and water, but demonstrate good moisture vapor transmissibility.

SUMMARY OF THE INVENTION

There is provided by this invention a process for producing a fully bonded nonwoven sheet from a lightly consolidated fibrous polyolefin sheet. According to the process, the lightly consolidated polyolefin sheet is provided to a first preheating roll, the first preheating roll having a rotating outer surface that is heated to a temperature within 15° C. of the melting temperature of the sheet. At least one face of the sheet is contacted with the heated surface of the first preheating roll to heat the sheet. The sheet is transferred from the first preheating roll to a rotating first heated calender roll, the first heated calender roll having an outer heated surface with a linear surface speed not less than the linear surface speed of the first preheating roll. The outer heated surface of the first heated calender roll is maintained at a temperature within 10° C. of the melting temperature of the sheet material and the surface of the sheet is contacted with the outer heated surface of the first heated calender roll. While the sheet is in contact with the first heated calender roll, the sheet is passed through a first nip formed between the first heated calender roll and a back-up roll, the first nip imparting an average nip pressure of at least 18 kg/linear cm on the sheet. The calendered sheet is transferred from the first heated calender roll to a first cooling roll, the first cooling roll having an outer cooling surface rotating at a linear surface speed not less than the linear surface speed of the first heated calender roll. The outer cooling surface of the cooling roll is maintained at a temperature at least 20° C. below the melting point of the sheet material, and the calendered sheet is contacted with the outer cooling surface of the first cooling roll for a period sufficient to cool the sheet to a temperature below the melting temperature of the sheet material, and stabilize the sheet material as a fully bonded nonwoven sheet. Finally, the fully bonded sheet is removed from the cooling roll.

The fibrous sheet material used in the process of the invention may be comprised of plexifilamentary film-fibrils.

Preferably, the outer heated surface of the first calender roll has a linear surface speed not less than the linear surface speed of the first preheating roll. It is also preferred that the outer cooling surface of said first cooling roll have a linear surface speed not less than the linear surface speed of the first calender roll. It is further preferred that each of the plurality of free spans, where the sheet is not in contact with any roll, between the sheet's first contact with the first preheating roll and the sheet's removal from the cooling roll be less than 20 cm.

When the sheet is transferred from the first heated calender roll to the first cooling roll, the sheet may be first transferred to a second heated calender roll, the second heated calender roll having an outer heated surface rotating at a linear surface speed not less than the linear surface speed of the first heated calender roll. The outer heated surface of the second calender roll is maintained at a temperature within 10° C. of the melting temperature of the sheet. The outer heated surface the second calender roll is contacted with the surface of the sheet opposite the sheet surface that contacted the first heated calender roll. While the sheet is in contact with the second heated calender roll, the sheet is passed through a second nip that imparts an average nip pressure of at least 18 kg/linear cm on the sheet. The calendered sheet is transferred from the second heated calender roll to a first cooling roll.

The process of the invention may be used to make a bonded polyolefin fibrous sheet having a basis weight in the range of 17 to 270 g/m$^2$, an average thickness in the range of 0.025 to 1.0 mm, a low air permeability expressed as Gurley-Hill porosity of at least 70 seconds, a low liquid water permeability expressed by a hydrostatic head pressure of greater than 170 cm according to AATCC standard 127, and a moderate moisture vapor transmission rate of at least 100 g/m$^2$ in 24 hours according to ASTM standard E96, method B. The process of the invention is especially useful for making a bonded fibrous sheet that is fully bonded. The process of the invention may also be used to make a bonded polyolefin plexifilamentary bonded film-fibril sheet having a basis weight of about 50 to 120 g/m$^2$, an average thickness in the range of 0.05 to 0.5 mm, with thickness standard deviation of less than 0.02, and a thermal transfer printing grade, according to ANSI Standard X3.182-1990, of at least "C".

BRIEF DESCRIPTION OF THE DRAWINGS

The accompanying drawings, which are incorporated in and constitute a part of this specification, illustrate the presently preferred embodiment of the invention and, together with the description, serve to explain the principles of the invention.

DETAILED DESCRIPTION OF THE PREFERRED EMBODIMENT

Reference will now be made in detail to the presently preferred embodiments of the invention, examples of which are illustrated below.

The nonwoven, sheet used in the process of the invention can be a polyolefin sheet material prepared by the process of Steuber, U.S. Pat. No. 3,169,899, which is hereby incorporated by reference. Preferred polyloefins include polyethylene and polypropylene, but it is anticipated that the process of the invention could be applied to other polyolefin-based fibrous sheets including sheets made from blends of polyolefins and other polymers. The preferred fibrous sheet material is comprised of at least 50% by weight polyolefin polymer. In the process of the Steuber patent, a solution of a desired polyolefin is flash-spun from a line of spinnerets to obtain continuous fibrillated plexifilamentary strands that are spread into a thin web by means of a rotating or oscillating baffle. The web is subsequently laid down onto a moving belt. The amount of spreading accomplished by each baffle and the degree of overlap of plexifilamentary material deposited on the belt by adjacent spinnerets is carefully controlled to give as uniform a distribution of fibers on the collecting belt as possible. The collected sheet of fibers is lightly consolidated by passing the fibers on the belt under a roll which applies a loading of less than 18 kg/linear cm (100 lbs/linear inch) to obtain a sheet that is subsequently passed through a fixed nip to provide the lightly consolidated sheet used as the starting material in the process of the present invention.

The starting sheet material for the process of the invention should have a basis weight of between about 30.5 and 271.2 g/m$^2$ (0.5 and 8.0 oz/yd$^2$). The edges of the unconsolidated sheet 11 are preferably trimmed by an edge trimmer prior to the start of the bonding process. A conventional edge trimming device may be used in conjunction with the feed roll 14 shown in FIG. 2. Preferably, the edges of the bonded sheet are trimmed again after bonding is complete. Alternatively, the sheet edges may be trimmed only after bonding of the sheet is completed.

Figure 2:
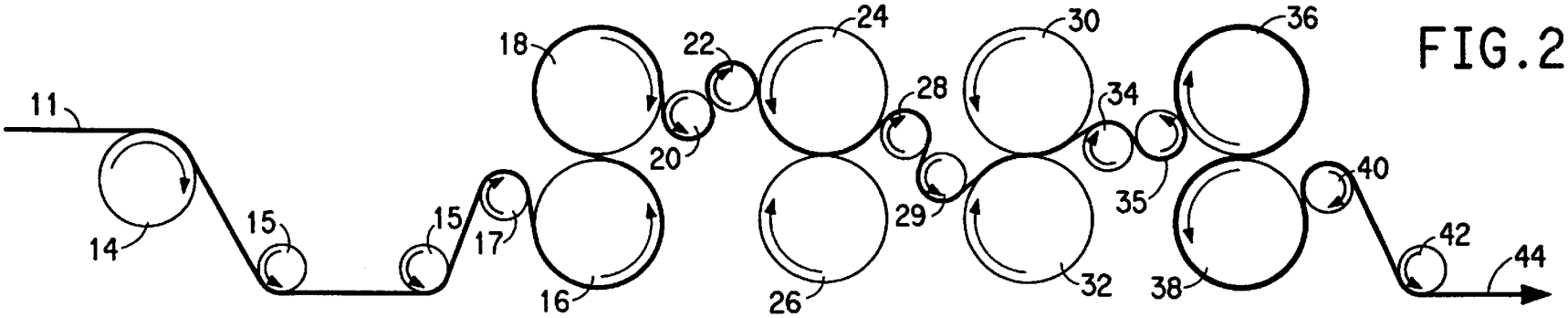
FIG. 2 is a schematic diagram of a process according to the invention for bonding nonwoven fibrous sheet material.

The bonding process of the invention is shown in FIG. 2. The bonding process takes place in three general operations. First, rolls 16 and 18 preheat the sheet. Second, rolls 24 and 26 calender bond one side of the sheet and rolls 30 and 32 calender bond the opposite side of the sheet. Third, rolls 36 and 38 cool and stabilize the sheet. The relative speeds of each of the rolls is controlled such that a desired level of tension is maintained in the sheet as it is being bonded. The bonding process is complete by the time the bonded sheet 44 comes off the cooling roll 38.

According to the sheet bonding process of the invention, the lightly consolidated sheet is first heated against one or more preheating rolls. According to the preferred embodiment of the invention, sheet 11 is guided by one or more fixed rolls 15 as the sheet travels from a feeder roll 14 to the first of two preheating rolls. Preferably, a fixed roll 17 guides the sheet 11 to a position on the heated roll 16 such that the sheet contacts a substantial portion of the circumference of roll 16. Fixed rolls 15 and 17 preferably have a diameter of about 20 cm. The sheet preferably travels from the first preheating roll 16 to second preheating roll 18. An adjustable wrap roll 20 is provided that is positioned close to the surface of roll 18, but that can be moved relative to the surface of roll 18 so as to permit adjustment of the distance over which the sheet and the preheating roll 18 is in direct contact. The position of wrap roll 20 relative to the surface of roll 18 is expressed in the examples below as the angle formed between a line passing through the centers of rolls 18 and 20 and a horizontal line passing through the center of roll 18. Fixed roll 17 could likewise be replaced by an adjustable wrap roll to permit additional adjustment of the distance over which the sheet contacts preheating roll 16.

Preheating rolls 16 and 18 preferably have a diameter that is large enough to provide good preheating of the sheet, even at relatively high sheet travel speeds. At the same time, it is desirable that rolls 16 and 18 be small enough such that the force of the sheet against the surface of the roll, in a direction normal to the roll surface, is great enough to generate a frictional force sufficient to resist sheet shrinkage. The force of the sheet against the roll in the direction normal to the roll surface is a function of the tension in the sheet and the diameter of the roll. As roll size increases, a greater sheet tension is required to maintain the same normal force. The frictional force that helps resist sheet shrinkage during bonding is proportional to the sheet force against the roll in the direction normal to the surface of the roll. The preferred diameter for the preheating rolls is in the range of 0.15 to 0.91 m (6 to 36 in), and more preferably about 0.53 m (21 in).

Preferably, rolls 16 and 18 are heated by hot oil pumped through an annular space under the surface of each roll. Alternatively, rolls 16 and 18 could be heated by other means such as electric, dielectric or steam heating. When a fully bonded sheet product is desired, the preheating roll surfaces are preferably heated to a temperature within 15° C. of the melting point of the sheet material being bonded. As used herein, the term "fully bonded sheet" refers to a sheet structure in which the fibers of the sheet are bonded to other fibers throughout the thickness of the sheet. Fibers are "bonded" when the fibers are connected or welded to other fibers in the sheet at a substantial majority of the points where the fibers of the sheet contact each other. In a very fully bonded fibrous sheet, most of the fibers are connected or welded to numerous other fibers in the sheet, and the sheet exhibits a hard paper-like feel. For example, when fully bonding a flash-spun polyethylene sheet, the preferred range of operating temperatures for the preheating rolls is 121° to 143° C. (250° to 290° F.). When a soft structure product with low internal bonding is desired, preheating rolls 16 and 18 are maintained at a temperature well below the sheet's melting temperature or even at ambient temperature. By adjusting the preheating roll temperature and the residence time of the sheet on the preheating rolls (by adjusting the roll speed and the position of the wrap roll 20), the temperature of the sheet going into the calendering operation can be carefully controlled.

The surface finish of preheating rolls 16 and 18 must be selected such that the coefficient of friction between the rolls and the heated sheet is high enough to resist sheet shrinkage. At the same time, the roll surface must readily release the sheet without sticking or picking of fibers, both of which can damage a sheet surface. In the preferred embodiment of the invention, preheating rolls 16 and 18 have polished chrome surfaces with a Teflon® release coating. Rolls having a chrome surface finished with a Teflonâ release coating, manufactured by HFW Industries, Inc. of Buffalo, N.Y., have been successfully used for preheating the sheet according to the process of the invention. Teflonâ is a registered trademark of DuPont.

The sheet tension and the friction between the sheet and rolls (which is a function of the sheet tension and roll size, as discussed above) combine to minimize sheet shrinkage or curling during the preheating step. Sheet curling arises when a sheet is not uniformly heated such that one side of a sheet shrinks more than the opposite side. Sheet tension arises from sheet shrinkage that occurs with heating and from increasing the linear surface speed of subsequent rolls. The roll speed differentials may be adjusted so as to achieve a desired sheet tension. The linear surface speed of rotating preheating roll 16 is preferably as fast as, or slightly faster than, the speed at which sheet 11 passes over feed roll 14. A small differential in roll surface speeds helps to maintain the sheet tension during preheating. Likewise, the surface of preheating roll 18 preferably moves at a linear speed as fast as, or slightly faster than, the surface speed of roll 16 to help maintain sheet tension on and between the preheating rolls. Preferably, the linear surface speed of roll 16 is at least about 0.2% faster than the linear surface speed of the feed roll 14, and more preferably about 0.5% faster than the linear surface speed of feed roll 14. Similarly, the linear surface speed of the second preheating roll 18 is preferably about 0.2% faster than the surface speed of the first preheating roll 16, and more preferably about 0.5% faster than the surface speed of the first preheating roll 16.

Shrinkage and curling of the sheet, as the sheet passes between rolls, are minimized by keeping the spans between rolls where the sheet is free of a roll surface to a minimum. Shrinkage and curling are also controlled by maintaining the sheet under tension in such free sheet spans. The smaller the diameter of preheating rolls 16 and 18, and wrap roll 20, and the closer the spacing of the rolls, the shorter are the free spans of the sheet between the rolls. The free sheet span between two rolls can be calculated as follows:

$$Span = \sqrt{(Gap + R_t)^2 - R_t^2}$$

where "Gap" is the distance between the roll surfaces and "$R_t$" is the combined radii of the two rolls. Preferably, the free span of the sheet being bonded between preheating rolls 16 and 18 is less than about 20 cm (7.9 in), and more preferably less than about 8 cm (3.2 in). For example, the free span between two 0.5 m diameter rolls spaced 0.6 cm from each other would be 7.8 cm.

According to the invention, the preheated sheet is next transferred to a thermal calender roll 24. In making the transfer from preheating roll 18 to calender roll 24, the sheet preferably passes over two adjustable wrap rolls 20 and 22. The free sheet spans between rolls 18 and 20, rolls 20 and 22, and rolls 22 and 24 should be kept to a minimum in order to control sheet shrinkage and curling. The use of small diameter wrap rolls 20 and 22, with diameters in the range of 15 to 25 cm (6 to 10 in), helps to minimize free sheet spans. Preferably, each of the free sheet spans between rolls 18 and 24 is less than 20 cm (7.9 in), and more preferably less than about 8 cm (3.2 in).

The tension in the sheet must be maintained as the sheet passes from preheating roll 18 to calender roll 24. Preferably, the linear surface speed of calender roll 24 is as fast as, or slightly faster than, the surface speed of preheating roll 18 to help maintain sheet tension in the free sheet spans between the preheating roll 18 and the calender roll 24, to maintain the sheet tension on the flexible wrap rolls 20 and 22, and to help maintain the sheet tension on the heated calender roll 24. The linear surface speed of calender roll 24 is preferably at least about 0.2% faster than the linear surface speed of preheating roll 18, and more preferably about 0.5% faster than the surface speed of feed roll 18. It is further preferred that the linear surface speed of calender roll 24 be no more than 2% faster than the speed of roll 18 in order to prevent stretching of the sheet. The position of the wrap roll 22 is adjustable along the surface of roll 24 for adjusting the degree of contact between the sheet being bonded and the heated calender roll 24. The position of wrap roll 22 relative to the surface of calender roll 24 is expressed in the examples below as the angle formed between a line passing between the centers of rolls 22 and 24 and a horizontal line passing through the center of roll 24. The surfaces of the wrap rolls used in the process of the invention (as well as the small fixed rolls) may each be machined with two spiral grooves that are oppositely directed away from the middle of the roll toward the opposite edges of the roll. The spiral grooves help keep the sheet spread in the cross direction which reduces cross-directional sheet shrinkage.

Preferably, calender roll 24 is heated by hot oil that is pumped through an annular space under the surface of the roll, but it may be heated by any of the means discussed above with regard to the preheating rolls. Where a fully bonded sheet is desired, the roll surface is preferably heated to a temperature within 10° C. of the melting temperature of the sheet material being bonded. For example, when a fully bonded flash-spun polyethylene sheet is desired, the preferred range of operating temperatures for the surface of roll 24 is from 130° to 146° C. (266° to 295° F.). Because the sheet has been preheated before reaching the calender roll 24, it is not necessary to use excessive calender roll temperatures to force high energy fluxes into the sheet. The application of such high energy fluxes is frequently undesirable in the bonding of web structures because high energy fluxes tend to cause excessive melting on the web surface.

The sheet being bonded is passed through a nip formed between the heated calender roll 24 and a back-up roll 26. In the preferred embodiment, the back-up roll 26 is an unheated roll with a resilient surface. However, it is contemplated that back-up roll 26 could have a hard surface and it is also contemplated that roll 26 could be a heated roll. The surface of back-up roll 26 moves at substantially the same speed as roll 24. The hardness of the resilient surface is selected in accordance with the desired nip size and pressure. A harder surface on roll 26 results in a smaller nip area. The amount of bonding in the nip is a function of the nip size and nip pressure. If a lightly bonded soft product is desired, the pressure in the nip between rolls 24 and 26 is kept low or roll 26 can be lowered to open up the nip altogether. Where it is desired to produce a more fully bonded product, such as a very fully bonded hard sheet, the nip pressure can be increased. For example, when a lightly consolidated sheet of flash-spun polyethylene is being bonded to form a fully bonded sheet product suitable for use as an air infiltration barrier housewrap material, a nip pressure in the range of 18–54 kg/linear cm (100–300 lbs/linear inch) is preferred. A fully bonded flash-spun polyethylene sheet material generally has a delamination strength in excess of 14 N/m (0.08 lbs/in).

Heated calender roll 24 and back-up roll 26 should have a diameter large enough to give them the strength to resist bending. In addition, roll 24 should be large enough that the sheet being bonded will be in contact with the roll surface for a desired period of time before entering the nip. On the other hand, smaller diameter rolls have the advantages that they are less expensive, they are easier to change out if a different embossing pattern is desired, and they generate a greater shrinkage resisting force normal to the roll surface (as discussed above). Preferably, calender roll 24 and back-up roll 26 have a diameter less than about 102 cm (40 in), and more preferably between about 0.15 and 0.91 m (6 and 36 in). In the examples below, 0.61 m (24 in) diameter rolls were used for calendar roll 24 and back-up roll 26.

The surface of heated calender roll 24 is selected such that the coefficient of friction between the roll and the heated sheet is high enough to resist sheet shrinkage. At the same time, the roll surface must readily release the sheet without sticking or picking of fibers. In the preferred embodiment of the invention, heated calender roll 24 has a smooth surface of a Teflon®-filled chrome material. If a bonding pattern is desired for the top surface of the sheet being bonded, the smooth calender roll may be replaced by a patterned roll. Chrome and Teflon® coated rolls finished by Mirror Polishing and Plating Company of Waterbury, Conn., have been successfully used in the calendar operation of the invention. Back-up roll 26 is preferably a hard rubber-surfaced roll with a surface hardness in the range of 60 on the Shore A Hardness Scale to 90 on the Shore D Harness Scale, as measured on an ASTM Standard D2240 Type A or D durometer. More preferably, back-up roll 26 has a surface hardness of 80 to 95 on the Shore A Hardness Scale.

The preferred process of the invention includes the step of passing the sheet through a second calender nip for bonding the side of the sheet opposite to the side bonded in the first nip associated with roll 24. Of course, if it is desired that a sheet product be bonded primarily on just one side, then one of the two nips can be operated in an open position or eliminated entirely. When a second nip is utilized, the sheet is transferred from the first calender roll 24 to a second heated calender roll 32. In making the transfer from roll 24 to roll 32, the sheet passes over a fixed roll 28 and an adjustable wrap roll 29. The free sheet spans between rolls 24 and 28, rolls 28 and 29, and rolls 29 and 32 are kept to a minimum in order to control sheet shrinkage and curling. The use of a small diameter fixed roll 28 and wrap roll 29, in the range of 15 to 25 cm (6 to 10 in), help to keep the free sheet spans to a minimum. Preferably, each of the free sheet spans between rolls 24 and 32 is less than about 13 cm (5.1 in), and more preferably less than about 8 cm (3.2 in). It is important that tension be maintained in the sheet between rolls 24 and 32.

Preferably, the linear surface speed of calender roll 32 is as fast as, or slightly faster than, the surface speed of calender roll 24 to help maintain sheet tension in the free sheet spans between the first and second calendering operations, to maintain the sheet tension on the fixed roll 28 and wrap roll 29, and to help maintain the sheet tension on the heated calender roll 32. The preferred linear surface speed of roll 32 is at least about 0.2% faster than the linear surface speed of calender roll 24, and more preferably about 0.5% faster than the linear surface speed of feed roll 24. It is further preferred that the linear surface speed of calender roll 32 be no more than 2% faster than the speed of calender roll 24 in order to prevent stretching of the sheet. The surface speed of back-up roll 30 is substantially equal to the surface speed of calender roll 32.

The position of the wrap roll 29 is adjustable along the surface of roll 32 for adjusting the degree of contact between the sheet being bonded and the heated calender roll 32. The position of wrap roll 29 relative to the surface of calendar roll 32 is expressed in the examples below as the angle between a line passing through the centers of rolls 29 and 32 and a horizontal line passing through the center of roll 32. Again, the surface of fixed roll 28 and wrap roll 29 may each be machined with two spiral surface grooves directed away from the middle of the rolls to help maintain cross-directional sheet tension.

Heated calender roll 32 is preferably similar to the heated calender roll 24 and the back-up roll 30 is preferably similar to the resilient-surfaced back-up roll 26, as described above.

The temperature of the rolls 24 and 32, the finish on the surface of the rolls 24 and 32, the pressure of the corresponding nips, the hardness of back-up rolls 26 and 30, and the degree of sheet wrap on the heated calender rolls can all be adjusted in order to achieve a desired type and degree of sheet bonding. For example, if hard, fully bonded, smooth-surfaced sheets are desired, both of the rolls 24 and 32 should be smooth heated calender rolls operated within the melting temperature range for the sheet material being bonded and relatively high nip pressures should be applied at both nips. If a textured sheet is desired, one or both of the smooth surfaced heated calender rolls could be replaced with patterned embossing rolls. If a lightly bonded softer product is desired, the temperature of the preheating rolls and the calendering rolls can be reduced, the degree of sheet wrap on the preheating and calender rolls can be reduced, and the nip pressures can be reduced in order to decrease the degree of bonding in the sheet.

In order to stabilize the bonded sheet (i.e., prevent curling or any additional shrinkage), the sheet is transferred from calender roll 32 and corresponding back-up roll 30 to a set of one or more cooling rolls. The cooling operation rapidly reduces the sheet temperature so as to stabilize the bonded sheet. In the preferred embodiment of the invention shown in FIG. 2, two cooling rolls 36 and 38 are used to quench the heated sheet. In making the transfer from calender roll 32 to cooling roll 36, the sheet preferably passes over two small fixed transfer rolls 34 and 35. The free sheet spans between rolls 30 and 34, between rolls 34 and 35, and between rolls 35 and 36 are kept to a minimum in order to control sheet shrinkage and curling. Preferably, small transfer rolls of 15 to 25 cm in diameter are used in order to reduce the free sheet spans between rolls 30 and 36 to less than about 20 cm (7.9 in), and more preferably to less than 8 cm (3.2 in). The surface speed of cooling roll 36 is preferably as fast as, or slightly faster than, the surface speed of calender roll 32 and back-up roll 30 to help maintain sheet tension in the free sheet spans between the calendering operation and the cooling operation, to maintain sheet tension on the fixed rolls 34 and 35, and to help maintain the sheet tension on the cooling roll 36. The preferred surface speed of cooling roll 36 is at least about 0.2% faster than the surface speed of calender roll 32, and more preferably about 0.5% faster than the surface speed of calender roll 32. Again, the surface of fixed rolls 34 and 35 may each be machined with two spiral surface grooves directed away from the middle of the rolls to help maintain cross-directional sheet tension.

Cooling rolls 36 and 38 are preferably of a diameter similar to that of the preheating rolls 16 and 18. The rolls must be large enough to have the strength to resist bending and to provide a residence time for the sheet on the rolls sufficient for adequate cooling. On the other hand, it is desirable for the rolls to be small enough that the force of the sheet against the rolls is sufficient to generate shrinkage resisting friction between the sheet and cooling rolls (as discussed above). In addition, smaller rolls are less costly to manufacture and install, and they are easier to move when desired. The cooling rolls should be close enough that the free sheet span between the rolls is as small as possible. The cooling rolls used in the examples below had a diameter of about 0.53 m (21 in). It is also important to maintain the sheet tension on and between cooling rolls, as for example by operating roll 38 at a surface speed as fast as, or slightly faster than, the surface speed of roll 36.

The rolls 36 and 38 cool opposite sides of the sheet. The rolls are preferably cooled by cooling water that passes through an annular space under the surface of each roll. The temperature of the cooling water pumped into the rolls is preferably at least 20° C. below the melting point of the sheet material, and more preferably at least 25° C. below the melting point of the sheet material. Where the process of the invention is used for bonding polyethylene plexifilamentary sheet, cooling roll temperatures between about 10° and 43° C. (50° and 110° F.) have been found to work well. If the sheet being bonded is a polyethylene plexifilamentary sheet, it is desirable for the temperature of the sheet to be reduced to a temperature below about 100° C. (212° F.) before coming off the cooling rolls. The cooling rolls preferably have a non-sticky surface such as a smooth polished chrome finish from which the bonded sheet 44 is easily removed.

The bonded sheet 44 is transferred to a take-up roll or to subsequent downstream processing steps, such as printing, by means of transfer rolls, such as the fixed rolls 40 and 42 shown in FIG. 2. After the sheet comes off the cooling rolls 36 and 38 and sheet bonding is complete, so it is no longer necessary to keep free sheet spans to an absolute minimum or to maintain sheet tension in order to resist sheet shrinkage and curling.

Figure 1:
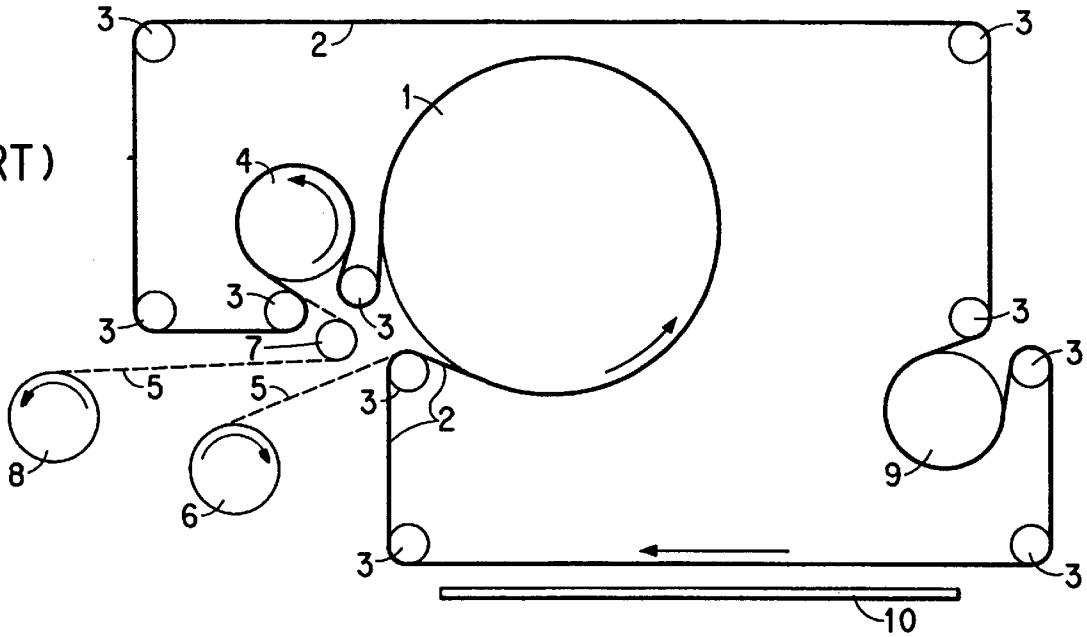
FIG. 1 (PRIOR ART)
FIG. 1 is a schematic diagram of a prior art process for bonding nonwoven plexifilamentary film-fibril sheet material.

The process described above is suited for making a broad range of nonwoven olefin bonded sheet products with a single set of process equipment. The process of the invention is especially suited for making fully bonded sheets in a manner that is quicker, simpler and less expensive than the prior art process shown in FIG. 1. By carefully controlling the temperature of the rolls, the speed of the rolls, the sheet residence time on the rolls, the tension in the sheet, the texture of the calender rolls, and the pressure of the calender nips, a wide variety of bonded products can be made. Great process flexibility is attained when each of the rolls is equipped with an independent drive and an individual speed controller. It has been found that with the process of the invention, wherein sheet tension is maintained during bonding, a higher degree of bonding can be achieved because the sheet can be subjected to bonding temperatures that are 1° to 2° C. higher than could be applied with the prior art bonding process without causing excessive melting of the sheet surface.

The process of the present invention has been found to be especially suitable for producing nonwoven olefin sheet products that are highly impermeable to air and water yet retain a substantial degree of moisture vapor transmissibility. The process described above has also been found to have great utility in bonding a fibrous nonwoven olefin sheet material to produce a bonded sheet that is strong and also has a smooth highly printable surface finish. The following non-limiting examples are intended to illustrate the process and products of the invention and are not intended to limit the invention in any manner.

TEST METHODS

In the description above and in the non-limiting examples that follow, the following test methods were employed to determine various reported characteristics and properties. ASTM refers to the American Society for Testing and Materials, TAPPI refers to the Technical Association of the Pulp and Paper Industry, and AATTC refers to the American Association of Textile Chemists and Colorists.

Basis Weight was determined by ASTM D-3776, which is hereby incorporated by reference, and is reported in $g/m^2$. The basis weights reported for the examples below are each based on an average of at least twelve measurements made on the sheet.

Thickness was determined by ASTM method D 1777-64, which is hereby incorporated by reference, and is reported in millimeters.

Tensile Strength and Elongation were determined by ASTM D 1682, Section 19, which is hereby incorporated by reference, with the following modifications. In the test a 2.54 cm by 20.32 cm (1 inch by 8 inch) sample was clamped at opposite ends of the sample. The clamps were attached 12.7 cm (5 in) from each other on the sample. The sample was pulled steadily at a speed of 5.08 cm/min (2 in/min) until the sample broke. The force at break was recorded Newtons/cm as the breaking tensile strength. The elongation at break is recorded as a percent of the original sample length. The tensile strength and elongation values reported for the examples below are each an average of at least twelve measurements made on the sheet.

Elmendorf Tear Strength is a measure of the force required to propagate a tear cut in a sheet. The average force required to continue a tongue-type tear in a sheet is determined by measuring the work done in tearing it through a fixed distance. The tester consists of a sector-shaped pendulum carrying a clamp that is in alignment with a fixed clamp when the pendulum is in the raised starting position, with maximum potential energy. The specimen is fastened in the clamps and the tear is started by a slit cut in the specimen between the clamps. The pendulum is released and the specimen is torn as the moving clamp moves away from the fixed clamp. Elmendorf tear strength is measured in Newtons in accordance with the following standard methods: TAPPI-T-414 om-88 and ASTM D 1424, which are hereby incorporated by reference. The tear strength values reported for the examples below are each an average of at least twelve measurements made on the sheet.

Hydrostatic Head measures the resistance of a sheet to the penetration by liquid water under a static load. A 316 $cm^2$ sample is mounted in an SDL Shirley Hydrostatic Head Tester (manufactured by Shirley Developments Limited, Stockport, England). Water is pumped against one side of a 102.6 $cm^2$ section of the sample until the sample is penetrated by water. The measured hydrostatic pressure is reported in centimeters of water. The test generally follows AATTC 127-1985, which is hereby incorporated by reference. The hydrostatic head values reported for the examples below are each based on an average of at least six measurements made on the sheet.

Gurley-Hill Porosity is a measure of the time required for 100 $cm^3$ of air to pass through a sample under standard conditions and is measured by TAPPI T-460 om-8, which is hereby incorporated by reference. The porosity values reported for the examples below are each based on an average of at least twelve measurements made on the sheet.

Moisture Vapor Transmission Rate (MVTR) was determined by ASTM E96-B, which is hereby incorporated by reference, and is reported in $g/m^2/24$ hr. The MVTR values reported for the examples below are each based on an average of at least four measurements made on the sheet.

Sheet thickness and uniformity were determined by ASTM method D 1777-64, which is hereby incorporated by reference. The thickness values reported for the examples below are each based on an average of at least 80 measurements taken on the sheet. The uniformity value ($\sigma$) represents the statistical standard deviation of the measured thickness values. A lower standard deviation is indicative of a more uniformly thick sheet.

Delamination Strength of a sheet sample is measured using a constant rate of extension tensile testing machine such as an Instron table model tester. A 1.0 in. (2.54 cm) by 8.0 in. (20.32 cm) sample is delaminated approximately 1.25 in. (3.18 cm) by inserting a pick into the cross-section of the sample to initiate a separation and delamination by hand. The delaminated sample faces are mounted in the clamps of the tester which are set 1.0 in. (2.54 cm) apart. The tester is started and run at a cross-head speed of 5.0 in./min. (12.7 cm/min.). The computer starts picking up readings after the slack is removed in about 0.5 in. of crosshead travel. The sample is delaminated for about 6 in. (15.24 cm) during which 3000 readings are taken and averaged. The average delamination strength is given in N/cm. The test generally follows the method of ASTM D 2724-87, which is hereby incorporated by reference. The delamination strength values reported for the examples below are each based on an average of at least twelve measurements made on the sheet.

Opacity is measured according to TAPPI T-519 om-86, which is hereby incorporated by reference. The opacity is the reflectance from a single sheet against a black background compared to the reflectance from a white background standard and is expressed as a percent. The opacity values reported for the examples below are each based on an average of at least twelve measurements made on the sheet.

Print Quality is measured according to ANSI X3.182-1990, which is hereby incorporated by reference. The ANSI X3.182-1990 test measures the print quality of a bar code for purposes of code readability. The test evaluates the print quality of a bar code symbol for contrast, modulation, defects, and decodability and assigns a grade of A, B, C, D or F for each category. An "A" grade is the highest grade and represents a highly readable code that can be decoded by the scanning unit with minimal mathematical computation. An "F" grade is the lowest grade for a bar code to which a scanner generates a response, and represents a bar code that requires extensive mathematical computation by the scanning unit to interpret. The overall grade of a sample is the lowest grade received in any of the above categories.

Testing was done on a Code 39 symbology bar code with the narrow bar width of 0.0096 inch that was printed on an Intermec 400 Printer manufactured by Intermec Inc. of Cincinnati, Ohio. Verification was done with a PSC quick check 200 scanner (660 nm wavelength and 6 mil aperture) manufactured by Photographic Sciences Corporation Inc. of Webster, N.Y. Print quality is generally dependent on the smoothness of the printing surface. The scanner was used with Scanalyst software from Automatic Identification Systems of Westerville, Ohio.

EXAMPLES

The non-woven flash-spun polyethylene plexifilamentary film-fibril sheet that was used in the examples is the same sheet material that when bonded is sold by DuPont as TYVEK® spunbonded polyolefin sheet. Four versions of the unbonded lightly consolidated plexifilamentary polyethylene sheet material were used as the starting sheet material in the examples. Type A had a basis weight of 49.4 $g/m^2$ and an average thickness of 0.171 mm. Type B had a basis weight of 66.4 $g/m^2$ and an average thickness of 0.244 mm. Type C had a basis weight of 72.5 $g/m^2$ and an average thickness of 0.264 mm. Type D had a basis weight of 53.2 $g/m^2$ and an average thickness of 0.151 mm.

Several bonding patterns were used in the examples below. Samples identified as having a "smooth" pattern have a flat smooth finish on both sides of the sheet. Samples identified as having a "bar" pattern have one side bonded with a smooth finish and the opposite side bonded with an array of alternating vertically oriented and horizontally oriented bar-shaped bonded sections in which each bonded bar section is about 0.5 mm wide and about 2.6 mm long, and in which the end of each bar is spaced about 1 mm from the side of an adjacent bar. Samples identified as having a "linen" pattern have one side bonded with a smooth finish and the opposite side bonded with a pattern having the appearance of a linen weave.

Comparative Example 1

In this example, a lightly consolidated flash-spun polyethylene Type A sheet was bonded according the prior art process described above and shown in FIG. 1. The bonded sheet had the following properties:

| | |
|---|---|
| Basis weight | 51.53 g/m$^2$ |
| Tensile strength-MD | 42.9 N/cm |
| Tensile strength-CD | 53.3 N/cm |
| Elmendorf tear-MD | 9.70N |
| Elmendorf tear-CD | 8.35N |
| Elongation-MD | 16% |
| Elongation-CD | 21.1% |
| Thickness | 0.151 mm |
| Thickness Std. Deviation | 0.021 |
| Hydrohead | 164.1 cm |
| Gurley Hill | 57.5 sec |
| MVTR | 856 g/m$^2$-24 hr |
| Delamination strength | 0.91 N/cm |

Examples 1–9

In the following examples, lightly consolidated flash-spun polyethylene sheets were bonded according the process shown in FIG. 2. Processing conditions and product properties are reported in Table 1 below.

TABLE 1

| Example | 1 | 2 | 3 | 4 | 5 |
|---|---|---|---|---|---|
| Sheet Type | A | A | A | A | A |
| Line Speed (mpm) | 61.0 | 121.9 | 61.0 | 106.7 | 91.4 |
| Preheat | | | | | |
| Bottom Roll | 60.0 | 120.1 | 59.7 | 104.9 | 88.4 |
| Top Roll | 60.4 | 120.4 | 60.0 | 105.2 | 90.2 |
| Calender Roll (Top) | 60.7 | 121.3 | 60.6 | 106.1 | 90.5 |
| Embosser Roll (Bot) | 61.0 | 122.5 | 60.4 | 105.5 | 89.9 |
| Cooling | | | | | |
| Top Roll | 61.3 | 122.5 | 61.3 | 107.3 | 92.1 |
| Bottom Roll | 61.6 | 123.1 | 61.6 | 107.9 | 92.4 |
| Temp. (° C.) | | | | | |
| Preheat | 132 | 129 | 129 | 132 | 138 |
| Calender | 134 | 134 | 133 | 134 | 138 |
| Embosser | 142 | 142 | 142 | 144 | 141 |
| Cooling Water | 12.8 | 12.2 | 12.2 | 12.2 | 10 |
| Calender Nip | | | | | |
| Nip Position | closed | closed | closed | closed | open |
| Pres. (kg/linear cm) | 21.48 | 24.16 | 21.48 | 31.86 | |
| Embosser Nip | | | | | |
| Nip Position | closed | closed | closed | closed | closed |
| Pres. (kg/linear cm) | 35.8 | 36.52 | 38.48 | 38.31 | 57.28 |
| Wrap Angle (degrees) | | | | | |
| Preheat | −45 | −45 | −45 | −45 | −45 |
| Calender | 35 | 34 | 35 | 35 | 40 |
| Embosser | 0 | 0 | 0 | 0 | 10 |
| Pattern | smooth | smooth | bar | bar | bar |
| Properties | | | | | |
| Basis Weight (g/m$^2$) | 52.2 | 50.2 | 50.2 | 50.5 | 51.5 |
| Thickness (mm) | 0.098 | 0.103 | 0.104 | 0.115 | 0.139 |
| Thickness Std. Dev. | 0.0098 | 0.0151 | — | 0.0211 | 0.0256 |

TABLE 1-continued

| | | | | | |
|---|---|---|---|---|---|
| Tensile, (N/cm) | | | | | |
| MD | 44.10 | 36.81 | 37.98 | 35.14 | 41.38 |
| CD | 49.40 | 40.24 | 41.82 | 38.80 | 44.75 |
| Elongation (%) | | | | | |
| MD | 19.19 | 10.53 | 10.80 | 11.10 | 12.50 |
| CD | 13.94 | 16.36 | 18.66 | 18.95 | 20.71 |
| Elmedorf Tear (N) | | | | | |
| MD | 7.57 | 12.06 | 11.93 | 11.57 | 10.86 |
| CD | 9.34 | 11.26 | 8.19 | 9.92 | 9.52 |
| Hydrohead (cm) | 254.25 | 237.34 | 262.99 | 278.66 | 170.66 |
| Gurley Hill (sec) | >300 | >300 | 9832 | 7299 | 211.8 |
| MVTR (gm/m$^2$-24 hrs.) | 384 | 324 | 434 | 405 | 901 |
| Delamination (N/cm) | 0.394 | 0.305 | | | |

| Example | 6 | 7 | 8 | 9 |
|---|---|---|---|---|
| Sheet Type | B | B | B | D |
| Line Speed (mpm) | 91.4 | 91.4 | 91.4 | 99.1 |
| Preheat | | | | |
| Bottom Roll | 89.6 | 89.6 | 88.9 | 96.6 |
| Top Roll | 89.6 | 89.6 | 91.2 | 97.6 |
| Calender Roll (Top) | 90.5 | 90.5 | 90.5 | 98.0 |
| Embosser Roll (Bot) | | 90.2 | 91.3 | 99.2 |
| Cooling | | | | |
| Top Roll | 91.7 | 91.7 | 91.8 | 99.5 |
| Bottom Roll | 93.0 | 92.7 | 92.8 | 100.5 |
| Temp. (° C.) | | | | |
| Preheat | 143 | 139 | 138 | 137.5 |
| Calender | 141 | 138 | 142 | 142.2 |
| Embosser | 144 | 139 | 143 | 143.8 |
| Cooling Water | 13.3 | 11.7 | 10.0 | 11.7 |
| Calender Nip | | | | |
| Nip Position | open | open | open | closed |
| Pres. (kg/linear cm) | | | | 35.7 smooth |
| Embosser Nip | | | | |
| Nip Position | closed | closed | closed | closed |
| Pres. (kg/linear cm) | 57.28 | 57.28 | 62.86 | 45.72 |
| Wrap Angle (degrees) | | | | |
| Preheat | −45 | −45 | −45 | −45 |
| Calender | 40 | 40 | 30 | 30 |
| Embosser | 10 | 10 | 15 | 15 |
| Pattern | bar | bar | linen | linen |
| Properties | | | | |
| Basis Weight (g/m$^2$) | 65.8 | 66.8 | 68.8 | 52.6 |
| Thickness (mm) | 0.203 | 0.219 | 0.169 | 0.122 |
| Thickness Std. Dev. | — | 0.026 | 0.036 | 0.016 |
| Tensile, (N/cm) | | | | |
| MD | 53.21 | 41.75 | 56.08 | 47.88 |
| CD | 50.68 | 42.05 | 58.90 | 46.90 |
| Elongation (%) | | | | |
| MD | 9.77 | 7.46 | 8.83 | 8.66 |
| CD | 13.49 | 11.3 | 15.7 | 13.83 |
| Elmedorf Tear (N) | | | | |
| MD | 9.92 | 13.93 | 8.19 | 6.85 |
| CD | 10.10 | 13.93 | 9.03 | 6.50 |
| Hydrohead (cm) | 226.85 | 216.15 | 212.5 | 287.2 |
| Gurley Hill (sec) | 80.83 | 88.67 | 455 | 455 |
| MVTR (gm/m$^2$-24 hrs.) | 1076 | 1081 | n/a | n/a |
| Delamination (N/cm) | | | 1.71 | 1.61 |

Comparative Examples 2–3

In the following examples, lightly consolidated flash-spun polyethylene sheets were bonded according the prior art process described above and shown in FIG. 1. The bonded sheet had the following properties:

| | Comp. Ex. 2 | Comp. Ex. 3 |
|---|---|---|
| Starting Sheet Type | Type C | Type B |
| Basis weight | 75 g/m$^2$ | 68 g/m$^2$ |
| Tensile strength-MD | 77 N/cm | 64 N/cm |
| Tensile strength-CD | 87 N/cm | 71 N/cm |
| Elmendorf tear-MD | 4.4N | 4.9N |
| Elmendorf tear-CD | 4.2N | 4.9N |
| Elongation-MD | 20% | 17% |
| Elongation-CD | 24% | 21% |
| Thickness | 0.193 mm | 0.191 mm |
| Thickness Std. Deviation (σ) | 0.023 | 0.023 |
| Delamination Strength | 0.74 N/cm | 0.56 N/cm |
| Opacity | 94% | 97% |
| Print Quality | F | F |

Example 10

In the following example, a lightly consolidated flash-spun polyethylene sheet was bonded according the process shown in FIG. 2. Processing conditions and product properties are reported in Table 2 below.

TABLE 2

| Example | 10 |
|---|---|
| Sheet Type | Type C |
| Line Speed (mpm) | |
| Preheat | |
| Bottom Roll | 14.93 |
| Top Roll | 14.93 |
| Calender Roll (Top) | 15.09 |
| Embosser Roll (Bot) | 15.03 |
| Cooling | |
| Top Roll | 15.33 |
| Bottom Roll | 15.36 |
| Temp. (° C.) | |
| Preheat | 134 |
| Calender | 143 |
| Embosser | 144 |
| Cooling Water | 12 |
| Calender Nip | |
| Nip Position | Closed |
| Pres. (kg/linear cm) | 49.65 |
| Embosser Nip | |
| Nip Position | Closed |
| Pres. (kg/linear cm) | 66.79 |
| Wrap Angle (degrees) | |
| Preheat | −45 |
| Calender | 0 |
| Embosser | 35 |
| Pattern | Smooth |
| Properties | |
| Basis Weight (g/m$^2$) | 74.6 |
| Thickness (mm) | 0.107 |
| Thickness Std. Dev. | 0.011 |
| Tensile (N/cm) | |
| MD | 71.8 |
| CD | 84.1 |
| Elemdorf Tear (N/cm) | |
| MD | 4.9 |
| CD | 5.3 |
| Delam. Strength (N/cm) | 0.858 |
| Opacity (%) | 86 |
| Print Quality (ANSI) | C |

It will be apparent to those skilled in the art that modifications and variations can be made in bonded polyolefin sheet products of the invention and in the process for making such products. The invention in its broader aspects is, therefore, not limited to the specific details or the illustrative examples described above. Thus, it is intended that all matter contained in the foregoing description, drawings and examples shall be interpreted as illustrative and not in a limiting sense.

What is claimed is:

1. A process for producing a highly bonded nonwoven sheet from a lightly consolidated fibrous sheet comprised of at least 50% by weight of polyolefin polymer, comprising the steps of:

providing the lightly consolidated fibrous polyolefin sheet to a first preheating roll having an outer surface rotating at a linear surface speed, said first preheating roll outer surface being heated to a temperature within 15° C. of the melting temperature of the sheet;

contacting at least one face of the sheet with the heated surface of the first preheating roll and heating the sheet;

transferring said heated sheet from the first preheating roll to a rotating first heated calender roll, said first heated calender roll having a diameter of less than 102 cm and having an outer heated surface with a linear surface speed not less than the linear surface speed of the first preheating roll and not more that 2% faster than the linear surface speed of the first preheating roll, said outer heated surface of said first heated calender roll being maintained at a temperature within 10° C. of the melting temperature of the sheet material;

contacting a surface of the sheet with said outer heated surface of the first heated calender roll;

while said sheet is in contact with said first heated calender roll, passing said sheet through a first nip formed between said first heated calender roll and a back-up roll, said first nip imparting an average nip pressure of at least 18 kg/linear cm on the sheet;

transferring said calendered sheet from the first heated calender roll to a first cooling roll, said first cooling roll having an outer cooling surface rotating at a linear surface speed not less than the linear surface speed of the first heated calender roll, said outer cooling surface of said cooling roll being maintained at a temperature at least 20° C. below the melting point of the sheet material;

contacting the calendered sheet with the outer cooling surface of the first cooling roll for a period sufficient to cool the sheet to a temperature below the melting temperature of the sheet material and stabilize the sheet material as a fully bonded sheet; and removing said fully bonded sheet from said cooling roll.

2. The process for producing a highly bonded nonwoven sheet according to claim 1 wherein the sheet is comprised of plexifilamentary film-fibrils.

3. The process for producing a highly bonded nonwoven sheet according to claim 2 wherein the sheet passes through a plurality of free spans between the sheet's first contact with the first preheating roll and the sheet's removal from the cooling roll where the sheet is not in contact with any roll, and wherein the length of each of said free spans is less than 20 cm.

4. The process for producing a highly bonded nonwoven sheet according to claim 2 wherein the step of transferring said sheet from the first heated calender roll to the first cooling roll further includes the steps of transferring said sheet from the first heated calender roll to a second heated calender roll, said second heated calender roll having an outer heated surface rotating at a linear surface speed not less than the linear surface speed of the first heated calender roll, said outer heated surface of said second calender roll being maintained at a temperature within 10° C. of the melting temperature of the film-fibrils of the plexifilamentary sheet;

contacting the outer heated surface the second calender roll with the surface of the sheet opposite the sheet surface that contacted the first heated calender roll;

while said sheet is in contact with said second heated calender roll, passing said sheet through a second nip formed between said second heated calender roll and a back-up roll, said second nip imparting an average nip pressure of at least 18 kg/linear cm on the sheet; and transferring said calendered sheet from the second heated calender roll to said first cooling roll.

5. The process for producing a highly bonded nonwoven sheet according to claim 4 wherein the outer heated surfaces of said first and second calender rolls are smooth and the surface of the resilient back-up roll of said first nip and the resilient back-up roll of said second nip are each made of a smooth resilient material.

6. The process for producing a highly bonded nonwoven sheet according to claim 4 wherein the outer heated surface of said first heated calender roll is smooth, the outer heated surface of said second heated calender roll has a textured embossing pattern, and the surface of the resilient back-up roll of said first nip and the resilient back-up roll of said second nip are each made of a smooth resilient material.

7. The process for producing highly a bonded nonwoven sheet according to claim 3 comprising the additional steps of:

transferring said heated sheet from said first preheating roll to a second preheating roll, said second preheating roll having a rotating outer heated surface moving at a linear surface speed at least 0.2% faster than the linear surface speed of the first preheating roll;

contacting a surface of said sheet that is opposite the surface of the sheet contacted with the first preheating roll with the heated surface of said second preheating roll to heat the contacted surface of the sheet, the heated surface of said second preheating roll being maintained at a temperature within 10° C. of the melting temperature of the sheet;

transferring said heated sheet from the second preheating roll to the first heated calender roll, the outer heated surface of said first heated calender roll having an outer heated surface rotating at a linear surface speed at least 0.2% faster than the linear surface speed of the second preheating roll.

8. The process for producing a bonded nonwoven sheet according to claim 7 further comprising the steps of passing the sheet over a first adjustable wrap roll means for adjusting the length of the surface of said second preheating rolls over which the sheet passes, and passing the sheet over a second adjustable wrap roll means for adjusting the length of the first heated calendering roll surface over which the sheet passes.

9. The process for producing a bonded nonwoven sheet according to claim 7 wherein the diameter of said first and second preheating rolls is in the range of 15 to 91 cm and wherein the diameter of said calender roll is within the range of 15 to 91 cm.

10. The process for producing a bonded nonwoven sheet according to claim 3 comprising the additional steps of:

transferring said heated sheet from said first cooling roll to a second cooling roll, said second cooling roll having an outer cooled surface rotating at a linear surface speed at least 0.2% faster than the outer surface speed of the first cooling roll;

contacting a surface of said sheet that is opposite the surface of the sheet contacted with the first cooling roll with the cooling surface of said second cooling roll and cooling the contacted second surface of the sheet to a temperature less than the melting temperature of the sheet; and removing said cooled sheet from the second cooling roll.

11. The process for producing a bonded nonwoven sheet according to claim 5 wherein the outer heated surfaces of said first and second calender rolls are each maintained at a temperature within 10° C. of the melting temperature of the film-fibrils of the plexifilamentary sheet.

* * * * *